United States Patent [19]

Youngkeit

[11] Patent Number: 4,561,377

[45] Date of Patent: Dec. 31, 1985

[54] APPARATUS FOR COATING FIBER MATERIALS WITH RESIN

[75] Inventor: Dean Youngkeit, Willard, Utah

[73] Assignee: Morton Thiokol, Inc., Chicago, Ill.

[21] Appl. No.: 622,907

[22] Filed: Aug. 9, 1984

Related U.S. Application Data

[62] Division of Ser. No. 504,634, Jun. 15, 1983, Pat. No. 4,530,855.

[51] Int. Cl.[4] ..... B05C 1/12; B05C 11/10

[52] U.S. Cl. ..... 118/33; 118/234; 118/246; 118/259; 118/674; 118/DIG. 20

[58] Field of Search ..... 118/33, 234, 246, 259, 118/DIG. 20, 674; 68/202

[56] References Cited

U.S. PATENT DOCUMENTS

| | | | |
|---|---|---|---|
| 3,498,262 | 3/1970 | Hill et al. | 118/234 |
| 3,791,900 | 2/1974 | Goerdeu et al. | 156/175 X |
| 3,993,805 | 11/1976 | Roberts | 427/175 |
| 4,517,916 | 5/1985 | Barch et al. | 118/234 |

*Primary Examiner*—Evan K. Lawrence

*Attorney, Agent, or Firm*—Gerald K. White

[57] ABSTRACT

Resin evenly applied to the surface of rotatable drive roller applicator is worked into the fibers of a band of fibrous material one ply thick by fiber tension, without abrasion. Resin is pumped to the roller applicator through a spring loaded applicator block in sealing contact with the surface of the applicator. The resin is pumped by a piston and cylinder pump at a rate determined by the rate of rotation of the applicator roller and thereby in accordance with the rate at which the fibrous band is pulled from the surface of the roller.

6 Claims, 2 Drawing Figures

APPARATUS FOR COATING FIBER MATERIALS WITH RESIN

This application is a division of application Ser. No. 504,634, filed June 15, 1983, U.S. Pat. No. 4,530,855.

BACKGROUND OF THE INVENTION

1. Field of the Invention

The present invention relates to an apparatus for impregnating fibrous material with a resin which is used as a matrix or binder in the production of a composite having application as a winding in the manufacture of hollow articles such as cylinders and spheres, for example, rocket motor cases, for confining fluid medium under high pressure.

2. Description of the Prior Art

In the prior art manufacture of composites of the abovementioned character, continuous cloth, roving or tow usually is passed through a dip tank of the resin that is to be used as a matrix. This procedure is common to filament winding, prepregging and pultrusion operations. With these systems, control of the resin percent by weight is through wipe or orifice scrape of excess resin from the fibrous material. Solvent extraction is used in conjunction with the wipe or scrape by prepreggers. With a prepreg operation, the resin content is often held to ±3% by weight, but presents problems in long run lots due to the evaporation of the solvent in the dip tank mixture. With a polar filament winding operation, historically, it has not been possible for the tumbling winding arm to house a dip tank system, and processing was limited to either prepreg or a hand brushed on coating of resin.

The following United States patents are a representative sample of the prior art methods of and apparatus for conditioning and handling the fibrous materials preliminary to its application as a winding in the manufacture of hollow articles: Daley et al U.S. Pat. No. 2,792,324; Schneiderman et al U.S. Pat. No. 3,021,241; and Young U.S. Pat. No. 3,047,191. Limitations of the known prior art systems of impregnation are: (1) scrape abrading of fibers; (2) inaccurate control of resin content; and (3) gravity dependency.

SUMMARY OF THE INVENTION

An object of the invention is to provide an improved apparatus for coating fibrous materials with a resin matrix or binder which is not subject to the foregoing limitations of the prior art.

Another object of the invention is to provide an apparatus for coating fibrous material or roving with resin which involves the use of a drive roller applicator and in which a bead of resin evenly applied to the cylindrical surface of the roller applicator is worked into the roving by roving tension, without abrasion.

A further object of the invention is to provide such an apparatus for coating fibrous material with resin in which the speed at which the resin roller applicator is rotated determines the rate at which the resin is delivered to the roller applicator.

In accomplishing these and other objectives of the invention, there is provided an apparatus for pumping and delivering resin in predetermined amounts evenly to the surface of a drive roller applicator and working the resin into the fibrous material or roving by roving tension, without abrasion. More particularly, a plurality of fibers are pulled from tensioning devices onto a plurality of positioning rollers to provide composition of a band of dry fibrous material one ply thick. The ply of fibrous material is pulled over the cylindrical surface of a resin driver roller applicator which serves (a) to gather multiple roving yarns or tows into a band, (b) to wet the band with material resin applied, and (c) to determine the pumping rate of a pumping apparatus that delivers the resin to the drive roller applicator via a resin applicator block that is operatively associated with the drive roller applicator.

BRIEF DESCRIPTION OF THE DRAWING

Having summarized the invention, a detailed description follows with reference being made to the accompanying drawings which form part of the specification, of which.

DESCRIPTION OF A PREFERRED EMBODIMENT

Figure 1:
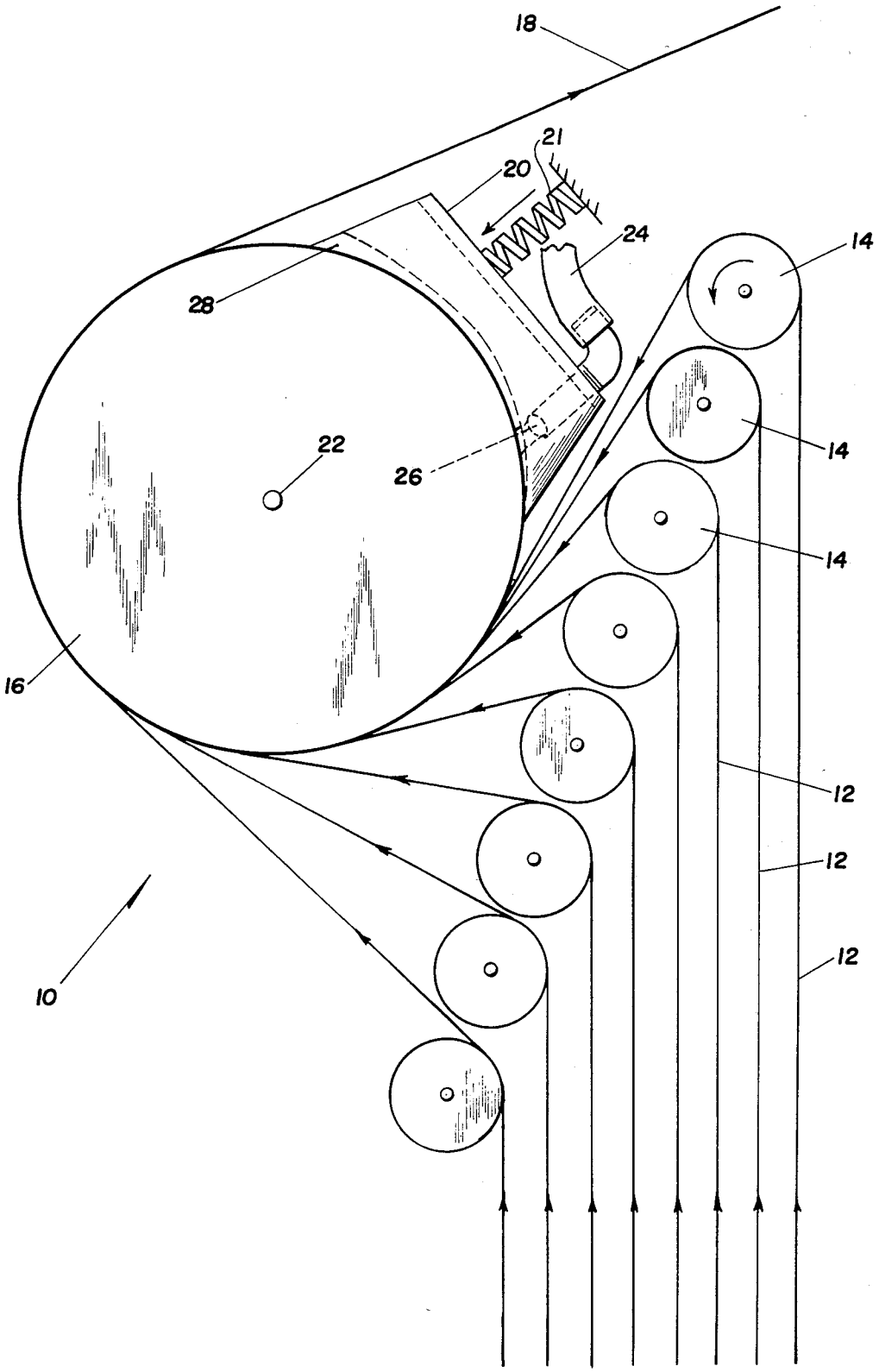
FIG. 1 is a schematic view showing a plurality of fibers being drawn from tensioners over a plurality of positioning rollers onto a resin driver roller applicator which gathers the fibers into a band, and further showing a resin applicator block positioned in operative relation to the spring loaded resin drive roller applicator.

Referring to FIG. 1 of the drawings, there is illustrated an apparatus 10 for coating fiber materials with resin wherein a plurality of fibers 12 are pulled from tensioning means (not shown, but which may be a type known in the art, as disclosed, for example in the aforementioned U.S. Pat. No. 2,792,324) onto a plurality of positioning rollers 14 that are evenly spaced on a line that is parallel to a tangent to the curvature of the surface of a rotatable resin drive roller applicator indicated at 16. Each of the positioning rollers 14 is rotatable counter clockwise and guides an individually associated one of the fibers 12 to compose a band of dry fibrous material one ply thick. The fibers 12 of the ply of material are each pulled tangentially into contact with the surface of the drive roller applicator 16. Resin is applied evenly to the surface of the applicator roller 16, the surface region of such application being generally opposite that of the tangential positions of contact of the fibers 7 with the surface of roller applicator 16 and the circumference thereof about which the fibers 7 are looped. As the fibers of the ply of material are pulled, the roller applicator 16 is rotated clockwise thereby wetting the fibers 7 with resin and working the resin into the fibers 7 by the fiber tension to form a resin impregnated band, as indicated at 18. The band 18 is drawn by means (not shown) from the drive roller applicator 16 to a mandrel (not shown) for winding thereon in the manufacture, for example, of a hollow article as aforementioned.

Figure 2:
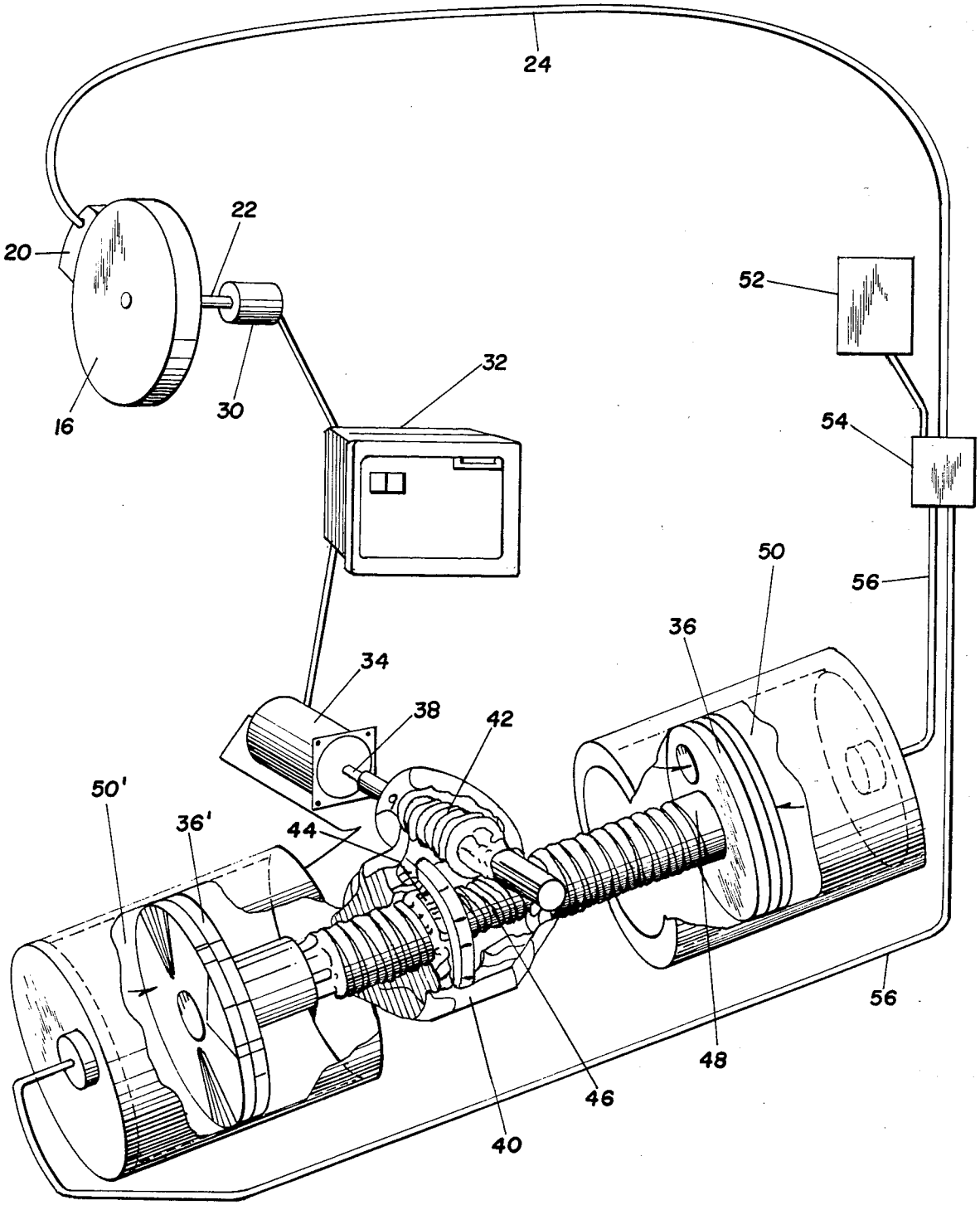
FIG. 2 is a view, partly in section, illustrating apparatus driven by the resin driver roller applicator for delivering resin from a source thereof to the resin applicator block at a rate determined by the rate of rotation of the drive roller applicator.

The drive roller applicator 16 serves three functions, namely (a) to gather multiple roving yarns or tows into a band, (b) to wet the band with resin and to work the resin into the fibers of the band, and (c) to regulate the operation of pumping apparatus as illustrated in FIG. 2 for delivering the resin to the fibrous band 18 from a source of resin.

Operatively associated with the resin drive roller 16 is a spring loaded resin applicator block 20 (the spring 21 is schematically illustrated) that is positioned on a peripheral side of the roller applicator 16 that is opposite to the fiber tangency side, the outline of the side of block 20 facing the surface of roller 16 matching the curvature thereof. The width of block 20 in the longitudinal direction of the shaft 22 about which roller 16 rotates is sufficient, at least, to embrace that portion of the circumference of roller applicator 16 on which the fibrous band 18 is formed. Block 20 is connected by TYGON (a trademark of U.S. Stoneware for polyvinylchloride) tubing 24 to the pumping apparatus that delivers the resin and is provided with orifices 26 for facilitating even spreading of the resin. A funnel-shaped cavity 28 provided at the upstream end of block 20 serves to converge excess resin on the surface of roller 16 from a previous revolution thereof.

Applicator block 20 thus provides the following functions: (a) orifices 26 spread the resin coming through the TYGON tubing 24; (b) a dragging seal of the sides of block 20 with the peripheral surface of roller 16 prevents drip loss of resin; and (c) the funnel-shaped converging and mixing cavity 28 recycles and mixes with new resin any fraction of resin that did not get picked up by fibers during the previous revolution of roller 16.

The block 20 desirably may be made of a solvent resistant lubricating plastic, for example, DELRIN (a trademark of E. I. DuPont de Nemours, for Acetalthermoplastic) with removable fittings for easy cleaning.

A form of apparatus that may be employed, according to the invention, for delivering resin to the applicator block 20 and drive roller applicator 16 is illustrated in FIG. 2. As shown in FIG. 2, an encoder 30 is attached to the shaft 22 of the roller applicator 16. Rotation of encoder 30 provides encoder output electrical signals to a microprocessor 32, said encoder output signals being representative of the rate of rotation of roller applicator 16. The microprocessor 32, translates the encoder electrical output signals into electrical drive signals at the output of microprocessor 32 that are appropriate for operating a 1.8° stepping motor 34. Stepping motor 34 operates opposed pistons 36 and 36', being connected to the latter by a shaft 38 and a gear box 40.

By way of example and not limitation, it is noted that the encoder 30 may comprise a DATAMETRICS #550-2000-5SE-F6S-1A (2000 pulses/revolution), the microprocessor 32 may comprise a MOTOROLA #MC6802 (basic component), and the stepping motor 34 may comprise a SUPERIOR #M-062-FD09 (1.8° rotation per step).

The gear box 40 includes a worm gear 42 that is attached to the shaft 38 of the stepping motor 34, and an annular gear 44. Annular gear 44 has external teeth that mesh with the teeth of the worm gear 42, and also has pre-loaded internal teeth that mesh with the teeth on a worm gear 46, the latter being provided on a shaft 48 that has piston 36 attached to one end and piston 36' to the other end.

The pistons 36 and 36' each fit into an individually associated cylindrical cavity 50 and 50'. Each piston 36 and 36' has the function of alternately pumping resin from the associated cylinder 50 and 50', respectively, through TYGON tubing 24 to the orifices 26 of applicator block 20 where the resin is evenly deposited on the peripheral surface of the driver roller 16, and of charging the associated cylinder 50' and 50, respectively, with resin from a source of supply. When reversed by a mechanism in the drive train and valves, as explained hereinafter, the piston and cylinder that had been performing the resin pumping function to the roller 16 becomes the charging piston and cylinder for the next cycle, and the piston and cylinder that had been charging is connected to perform the resin pumping function to the surface of the roller 16. To this end a supply of resin contained in a container 52 is connected by a valve 54 to the opposed ends of each of the cylinders 50 and 50' by TYGON tubing 56 and 56', respectively. Valve 54, which may comprise a NUPRO #B-12C4-10 (spring loaded ball check), is operated alternately to connect the resin being pumped from one cylinder 50 and the other cylinder 50' to the TYGON tubing 24 and thereby to the applicator block 20'.

Thus, the apparatus comprises an opposed piston pump that operates in each cycle to pump resin to the roller 16 from one cylinder 50 and to charge the other cylinder 50' from a source of resin for use in pumping resin to the roller 16 in the next cycle. The apparatus operates at an extremely slow piston speed. The speed at which the applicator drive roller rotates, along with a microprocessor or gear multiplier, determines the rate at which resin is delivered to the surface of the drive roller 16.

In accordance with the invention, it is contemplated that the microprocessor may provide up to 6000 steps per encoder revolution, or up to 9550 steps per second at 300 feet per minute. The direction of the stepper motor rotation is reversed by the microprocessor 32 after a number of steps that is calculated to empty one cylinder 50 and to charge the other cylinder 50' and vice versa. For maintaining the resin in the cylinders 50 and 50' at a value that has been determined as best for performing the fiber impregnating function, each of the cylinders 50 and 50' and the container 52, also may be contained within an insulating temperature controlling jacket. Suitable temperature control means, as known in the art, may also be employed, if desired, to maintain the resin within the cylinders 50 and 50' and container 52 at the desired temperature value.

As those skilled in the art understand, it is contemplated that in a modified apparatus embodiment of the invention, the encoder 30, microprocessor 32, and stepping motor may be dispensed with and a change gear train substituted therefor, such change gear train being connected between shaft 22 of roller 16 and shaft 38 of gear box 40. Change gears may be employed that would provide thousands of ratios that could be selected from a chart.

Thus, there has been provided, according to the invention, an apparatus for coating fibrous materials which does not involve scrape abrading of the fibers to remove excess resin, which enables accurate control of the resin content picked up by the fibers, and which is not gravity dependent. The apparatus according to the invention, on the other hand, enables the even application of resin to the surface of the drive roller applicator 16 where the resin is worked into the fibers by fiber tension, without abrasion of the fibers. Additionally, the resin is pumped to the surface of the roller applicator 16 at an accurately metered rate in accordance with the speed of rotation of the roller applicator 16.

With apparatus for coating fiber materials with resin, there is enabled a substantial saving of resin which may be as much as 50%, for example, of the resin normally used for wet winding of rocket motor cases.

The invention is further characterized in that it removes speed restrictions, pump cleaning problems and a controlled quantity (±1% or less) of resin in the resulting fibrous band 18. Additionally, and importantly, the apparatus of the invention promotes uniform strength in the resulting composite and provides improved strength per unit weight of the resulting case or hollow article. Also, there is promoted, geometrically precise winding with a minimum of fiber abrasions. The apparatus is capable of infinite resin delivery rate adjustment within fiber speed limitations. It is also possible to provide a calibration of the apparatus to a table of numerical values to produce specified resin contents of the fibrous band 18.

It is noted that, in the use of the apparatus, streaked material may be produced. Even distribution of the metered resin is accomplished by capillary seeping of the resin amount into the band after it has been on a mandrel for several minutes.

The apparatus has value to pre-preggers as well as filament winders. The pre-pregger has the option of using a solvent or hot melt application process. The pre-pregger will find value in using this process in that solvent cut resin solids maintain a consistent ratio in a closed system. This is opposed to a fiber churned dip tank wherein solvent percentage changes and thus on a spool of roving, resin solids are greater on the outside than at the inside diameter.

What is claimed is:

1. Apparatus for coating fiber materials with resin comprising, a plurality of positioning rollers having axes of rotation which are all parallel, a rotatable drive roller applicator having an axis of rotation that is parallel to the axes of rotation of said positioning rollers, each of said plurality of positioning rollers being positioned adjacent said drive roller applicator and being adapted for having a fiber individual thereto pulled under tension thereof and dircted thereby tangentially to the surface of said drive roller applicator, said positioning rollers being positioned in a substantially evenly spaced relationship on a line that is parallel to a tangent to the to the curvature of the adjacent surface of said drive roller applicator, said drive roller applicator being operative to gather fibers looped around a substantial portion of the circumference thereof into a fibrous band as the fibers are pulled under tension over a substantial portion of the circumference thereof, and means for depositing resin under pressure on a surface of said drive roller applicator that is opposite to the portion of the circumference thereof about which the fibrous band is pulled, said means for depositing resin to the surface of the drive roller applicator including a spring loaded applicator block in sealing contact with the surface of said roller applicator, said block having orifices therein facing the surface of said roller applicator and from which resin is adapted to issue for even distribution thereon, and pumping means connecting said orifices to a source of resin under pressure.

2. Apparatus as specified in claim 1 further including rotation responsive means responsive to the rate at which said drive roller applicator is rotated for controlling the rate at which said pumping means delivers resin through said orifices of said applicator block to the surface of said drive roller applicator.

3. Apparatus as specified in claim 2 wherein said drive roller applicator includes a shaft that is fixedly attached thereto and said rotation responsive means includes an encoder that is connected to said shaft for providing an electrical signal output that is representative of the speed of rotation thereof, and further including a microprocessor, a stepping motor, and gear means connecting said stepping motor to said pumpiing means, said microprocessor being operatively connected to said encoder and to said stepping motor and being operative to translate said encoder electrical signal output into a microprocessor electrical signal output that is appropriate for operaing said stepping motor, said stepping motor operating through said gear means in response to said microprocessor electrical signal output to actuate said pumping means.

4. Apparatus as specified in claim 3 wherein said stepping motor has an output shaft and said gear means includes a first worm gear, a second worm gear and an annular gear having an inner gear and an outer gear, and wherein said pumping means includes a first cylinder and a first piston movable therein, said piston having a piston shaft connected thereto, said first worm gear being fixedly attached to the output shaft of said stepping motor and positioned to mesh with the outer gear of said annular gear, said second worm gear being integral with said piston shaft, and said inner gear of said annular gear being positioned to mesh with said second worm gear whereby upon rotation of said stepping motor shaft said first piston is moved within said first cylinder.

5. Apparatus as specified in claim 4 wherein said pumping means further includes valve means connecting said cylinder to a source of resin and operative to allow resin to flow into the cylinder from the source upon outward movement of the piston with respect to the cylinder thereby charging the cylinder with resin and allowing resin to be pumped to the orifices of said applicator block upon inward movement of the piston with respect to the cylinder.

6. Apparatus as specified in claim 5 wherein said pumping means further includes a second cylinder and a second piston movable in said second cylinder, said second piston being attached to one end of said piston shaft and said first piston being attached to the other end of said piston shaft with said second worm gear being located on said piston shaft at an intermediate position thereof, said valve means being connected to said second cylinder, and wherein said valve means is operative in a first cycle of operation in which said stepping motor output shaft is rotated in a first direction to connect said first cylinder for pumping resin from said first cylinder to the orifices of said applicator block upon inward movement of said first piston in said first cylinder and to connect said second cylinder for charging with resin from the source upon outward movement of said second piston from said second cylinder, said valve means being operative in a second cycle of operation in which said stepping motor output shaft is rotated in a second direction to connect second cylinder for pumping resin from said second cylinder to the orifices of said applicator block upon inward movement of said second piston in said second cylinder and to connect said first cylinder for charging with resin from the source upon outward movement of said first piston from said first cylinder, said first and second cycles alternating.

* * * * *